United States Patent [19]

Vieux et al.

[11] Patent Number: 4,943,254

[45] Date of Patent: Jul. 24, 1990

[54] METHOD FOR THE FABRICATION OF AN IMPROVED X-RAY IMAGE INTENSIFIER TUBE, AND INTENSIFIER TUBE, AND INTENSIFIER TUBE OBTAINED THEREBY

[75] Inventors: Gárard Vieux, Grenoble; Francis Diaz, Moirans; Paul de Groot, St-ismier, all of France

[73] Assignee: Thomson-CSF, Puteaux, France

[21] Appl. No.: 375,997

[22] Filed: Jul. 6, 1989

[30] Foreign Application Priority Data

Jul. 8, 1988 [FR] France ..... 88 09310

[51] Int. Cl.[5] ..... H01J 9/20; G21K 4/00

[52] U.S. Cl. ..... 445/28; 427/74; 313/530

[58] Field of Search ..... 313/529, 530; 427/74; 378/74; 445/28

[56] References Cited

U.S. PATENT DOCUMENTS 3,846,654 11/1974 Franz ..... 313/529
4,459,508 7/1984 Ichikawa .
4,862,006 8/1989 Vieux ..... 250/487.1

FOREIGN PATENT DOCUMENTS 0249547 12/1987 European Pat. Off. .

*Primary Examiner*—Kenneth J. Ramsey
*Attorney, Agent, or Firm*—Oblon, Spivak, McClelland, Maier & Neustadt

[57] ABSTRACT

Disclosed is a method for the fabrication of an X-ray image intensifier tube. Before being introduced into the X-ray image intensifier, one of all the electrodes are entirely or partially covered with a layer of an orgainc polymer which is an electronic conductor of electricity and which has the property of reacting chemically with the alkaline metals deposited on the electrodes. Thus, the spurious illumination of the observation screen, due to the alkaline metals deposited on the electrodes during the preparation of the photocathode, is eliminated.

7 Claims, 2 Drawing Sheets

METHOD FOR THE FABRICATION OF AN IMPROVED X-RAY IMAGE INTENSIFIER TUBE, AND INTENSIFIER TUBE, AND INTENSIFIER TUBE OBTAINED THEREBY

BACKGROUND OF THE INVENTION

1. Field of the Invention

The present invention concerns a method for the fabrication of an X-ray image intensifier tube. It also concerns X-ray image intensifier tubes with high vacuum obtained thereby.

2. Description of the Prior Art

X-ray image intensifier tubes are well known in the prior art. They convert an X-ray image into a visible image, for example in order to provide for medical observation.

The problem that arises, and that the present invention seeks to resolve, is the fact that a spurious illumination is observed in the X-ray image intensifiers, even when there is no X-radiation. This spurious illumination is troublesome for the observation screen. It is due to the alkaline metals deposited involontarily on the electrodes of the X-ray image intensifier tubes when the photocathode is being made. The intense electrical field that prevails in the tube manages to liberate electrons from these alkaline metals which are highly electropositive and, therefore, easily ionizable. These electrons go up along the electrical field, strike the observation screen and create a spurious illumination.

It will be recalled that alkaline antimonide type photocathodes are fabricated in the vacuum chamber of the X-ray image intensifier tube, for alkaline metals are higly reactive and have to be created under vacuum to be stable. These photocathodes can be made by successive operations for the vapor deposition of their constituent elements, in the tube, using a common type of crucible containing antimony, the evaporation of which is caused by heating the crucible, by Joule effect for example. The alkaline metals are evaporated by means of generators generally located on the electrode closest to the anode.

The evaporation of alkaline metals is the result of a silicothermic or aluminothermic process on the chromates or metals sought to be evaporated. The silicothermic or aluminothermic processes are set off by the heating, by Joule effect, of the alkaline generators.

Alkaline generators are far less directive than antimony generators. This is because, for the silicothermic or aluminothermic processes to take place efficiently, it is necessary to use special crucibles in which the chromates are confined. This type of crucible has poor directivity, the advantage of which is that it ensures a properly uniform deposition of the alkaline metals throughout the surface of the photocathodes which is at a distance from these crucibles. On the other hand, it has the drawback of causing the deposition of alkaline metals on all the parts of the X-ray image intensifier tube, and notably on the electrodes, thus causing the problem of spurious illumination on the observation screen.

To resolve this problem, one method used by the Applicant is to put a coating of aluminium oxide $AlO_3$ on the electrode closest to the anode, generally made of aluminium itself.

This approach makes it possible to eliminate the spurious illumination of the observation screen but introduces electrical discharges through this layer of oxide, which is an electrical insulator.

When the X-ray image intensifier tube receives an X-radiation, a portion of the electrons coming from the photocathode falls on this electrode. Since this electrode is coated with a layer of oxide, these electrons do not flow and discharges are created through the oxide layer.

In another known approach to the problem referred to, which does not have the drawbacks of the above known approach, before introducing it into the intensifier there is deposited, at least on a part of an electrode or electrodes, a layer of an electricity conducting material having the property of oxidizing the alkaline metals that go into the composition of the photocathode. This material may be chosen from among the following elements: Te, Se, S, P, in preferred embodiments.

The present invention seeks to propose a variant of this latter approach which preserves the advantages of a barrier layer holding the electrons of the conductive alkaline metals while, at the same time, making its application and implementation simpler.

SUMMARY OF THE INVENTION

To this effect, a first object of the invention is a method for the fabrication of an improved X-ray image intensifier tube with, notably, a photocathode comprising an alkaline antimonide, several electrodes and an anode, wherein, prior to the fabrication of the cathode by means of a vapor deposition of antimony and alkaline metals, there is deposited, before introducing it into the tube, on at least a part of the electrode which is closest to the anode, a layer of a conductive material having the property of reacting with the above mentioned alkaline metals. According to the general characteristic of the invention, the conductive material is chosen from among the organic polymers which are electronic conductors of electricity.

A second object of the invention is an improved X-ray image intensifier tube with, notably, a photocathode comprising an alkaline antimonide, several electrodes and an anode, wherein at least one part of at least one electrode and parts electrically connected to an electrode or to the anode of the intensifier, bears a layer of organic polymer which is a conductor of electricity having the property of reacting chemically with the alkaline metals that enter into the composition of the photocathode.

BRIEF DESCRIPTION OF THE DRAWINGS

Other objects, features and results of the invention will emerge from the following description, given as a non-restrictive example and illustrated by the appended drawings, of which.

In the different figures, the same references are repeated for the same elements but, for reasons of clarity, the dimensions and proportions of the different elements have not been maintained.

DESCRIPTION OF PREFERRED EMBODIMENTS

Figure 1:
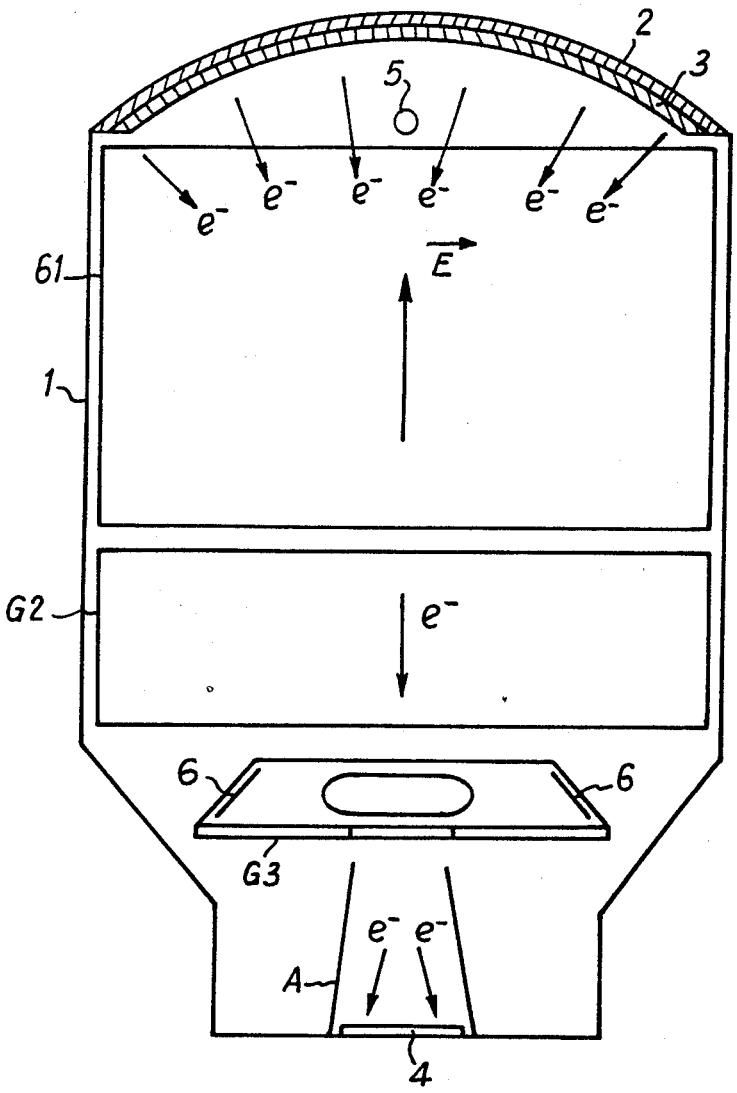
FIG. 1 shows a schematic, longitudinal sectional view of an X-ray image intensifier tube.

An X-ray image intensifier, shown schematically in longitudinal section in FIG. 1, is formed by an input screen, an electronic optical system and an observation screen contained in a chamber 1 under vacuum.

The input screen has a scintillator 2 which converts the incident X photons into visible photons, a photocathode 3 which converts the visible photons into electrons. Between the scintillator and the photocathode, there is generally interposed an electricity conducting sub-layer which has the role of re-supplying the photocathodes with electrical charges while it emits electrons. This sub-layer is not shown in FIG. 1.

The scintillator may be formed, for example, by cesium iodide doped with sodium or thallium. The photocathode may be formed by an alkaline antimonide. The conductive sub-layer may be formed, for example, by indium oxide with the formula $In_2O_3$.

The electronic optical system is generally formed by three electrodes $G_1$, $G_2$, $G_3$ and an anode A bearing the observation screen 4.

The photocathode 3 is generally connected to the ground of the tube. The electrodes $G_1$, $G_2$, G3 are carried to increasing electrical potentials up to 30 kV, for example. Thus, an electrical field E is created in the tube. This electrical field E is directed along the longitudinal axis of the tube, towards the photocathode. The electrons coming from the photocathode go up this field and strike the observation screen 4, formed by a cathodoluminescent material such as zinc sulphide, for example, thus enabling a visible image to be obtained.

Figure 2:
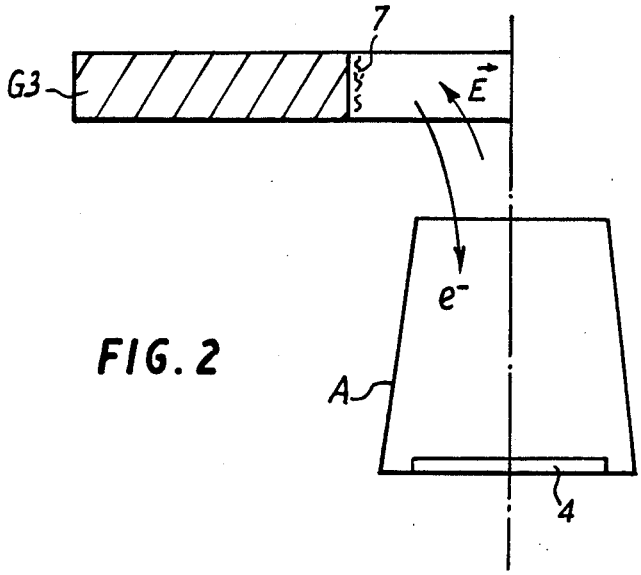
FIG. 2 shows a sectional view of the electrode $G_3$, which is closest to the electrode, without particular means for the retaining of alkaline electrons.

FIG. 2 shows a partial sectional view of the of the grid $G_3$ and the anode A of the X-ray image intensifier tube of FIG. 1. The reference 7 designates the layer of alkaline metals, which is deposited on the grid $G_3$ during the fabrication of the cathode and which, under the effect of the electrical field E, prevailing between the grid $G_3$ and the anode A and pointed towards the grid $G_3$, releases electrons that go up the electrical field and strike the observation screen 4.

Figure 3:
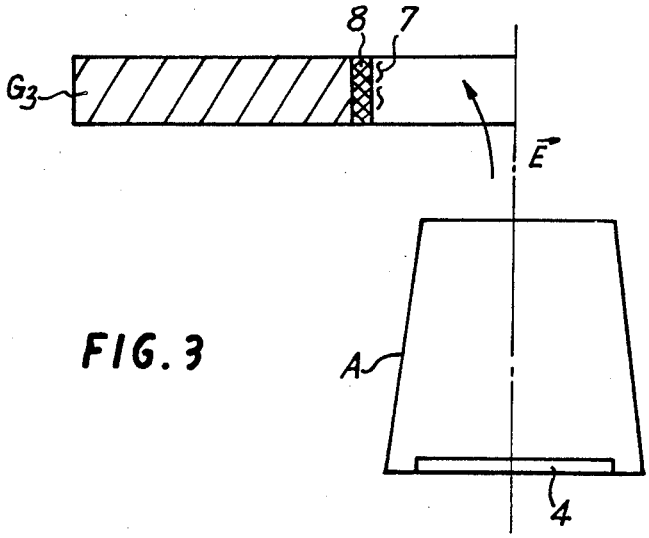
FIG. 3 shows a schematic sectional view, similar to that of FIG. 2, of the solution provided by the invention.

FIG. 3 shows a partial sectional view of the electrode $G_3$ and the anode A of the X-ray image intensifier tube of FIG. 1, illustrating the solution provided by the invention to the above-mentioned problem of spurious illumination.

The problem of spurious illumination is due to the metallic nature of the parasite alkaline materials. The solution proposed by the invention is to make these alkaline metals react chemically with a material capable of converting them into ionic or covalent compounds. Thus the alkaline metals are bound and no longer release any electrons creating the spurious illumination which it is sought to eliminate. The deposit used should furthermore be electrically conductive so as to avoid the discharge phenomena encountered in the prior art when an oxide layer covers the electrode $G_3$.

Thus, before introducing it into the vacuum chamber of the X-ray image intensifier tube, there is deposited, on the grid $G_3$, on which the antimony generators are generally mounted a layer of an electricity conducting material that has the property of reacting with the alkaline metals.

According to the present invention, it is proposed to coat one or all the electrodes $G_1$, $G_2$, $G_3$ as well as any internal part of the tube capable of receiving alkaline metals, with an electrically conductive organic polymer. This conductive organic polymer could cover all or only a part of the electrode or of the part concerned.

The conductive organic polymer could be chosen from among the following, given by way of non-exhaustive examples: polypyrrole, polythiophene, polyaniline, polyvinylferrocene (PVF), polythiazil, polyacetylene, polyparaphenylene or any other electron conductive organic material.

FIG. 3 shows that the electrode $G_3$ is coated with a layer 8 of polymer before being introduced into the X-ray image intensifier tube. It is possible to coat the entire electrode $G_3$ with polymer, as is the case in FIG. 3, or only those zones of the electrode $G_3$ which are most liable to provoke the phenomenon of spurious illumination. These zones may be determined experimentally. They may also be determined by computation, using computer programs. The zones most liable to provoke the phenomenon of spurious illumination are generally highly curved zones with a small radius of curvature and a strong electrical field. These zones are located in the vicinity of the alkaline geerators and the observation screen. In FIG. 3, it is seen that the periphery of the hole of the electrode $G_3$, which enables the electrons to pass through, has been covered with the layer 8.

The arrival of parasite alkaline metals during the fabrication of the photocathode causes the following reaction on the surface of the layer 8 of polymer if cesium is evaporated:

Cs + polymer → products of reactions

Hence, it is not alkaline metals but compounds containing these alkaline metals that are found on the layer 8.

There are two types of methods used to obtain these polymers: chemical deposition and electrochemical deposition.

These polymers actually exist in two forms: oxidized form and reduced form. The oxidized form is conductive while the reduced form is insulating.

The chemical deposition of a polymer entails mixing the basic monomer (for example pyrrole, marked PY) with a chemical agent which is a polymerizing agent and an oxidizing agent at the same time. The following are the most commonly used chemical agents that meet these constraints:

Ferric perchlorate: $Fe(ClO_4)_3$

Ferric chloride: $FeCl_3$

Iodine: $I_3$

In the case of $FeCl_3$, the ferric ion is the oxidizing ion and the ion $ClO_4$ serves to respect the electroneutrality of the polymer:

$$nFe^{3+} + ne^- \rightleftarrows nFe^{2+}$$

$$nPY \rightleftarrows nPY^{\oplus} + ne^-$$

$$nPY^{\oplus} + n\ ClO_4^- \rightleftarrows [PY,\ ClO_4]_n$$

Giving the overall reaction:

$$nPY + nFe^{3+} + n\ ClO_4^- \rightarrow nFe^{2+} + [PY,\ ClO_4]_n$$

$$nPY + nFe(ClO_4)_3 \rightarrow (PY,\ ClO_4)_n + nFe^{2+} + 2n\ ClO_4^-$$

Thus, polypyrrole is formed on the electrode $G_3$, for example, present in the reaction bath.

The second method of obtaining these polymers is electrochemical oxidation wherein the oxidation and the polymerization are done on the electrode connected to the positive terminal of the electrical generator, the bath being made up of the basic monomer (pyrrole for example) diluted in an organic or aqueous solvent.

What is claimed is:

1. A method for the fabrication of an improved X-ray image intensifier tube with, notably, a photocathode comprising an alkaline antimonide, several electrodes and an anode, wherein, prior to the fabrication of the cathode by means of a vapor deposition of antimony and alkaline metals, there is deposited, before introducing it into the tube, on at least a part of the electrode which is closest to the anode, a layer of a conductive material having the property of reacting with the above mentioned alkaline metals, said conductive material being chosen from the group consisting of electrically conductive organic polymers.

2. A method according to claim 1, wherein said organic polymer is chosen from among the following: polypyrrole, polythiophene, polyaniline, polyvinylferrocene, polythiazil, polyparaphenylene.

3. A method according to either of the claims 1 or 2, wherein the deposition is done by placing the electrode or the part of the electrode to be coated in a reaction bath comprising a mixture of basic monomer with an oxidizing and polymerizing chemical agent.

4. A method according to claim 3, wherein the oxidizing chemical agent is chosen as being iron perchlorate, iron chloride or iodine.

5. A method according to claim 1 wherein the deposition is done by an electrochemical oxidation of the electrode or of that part of an electrode to be coated, the latter forming the anode of the electrolytic reactor in which the electrolyte is an aqueous or organic solution of the basic monomer.

6. An improved X-ray image intensifier tube with, notably, a photocathode comprising an alkaline antimonide, several electrodes and an anode, wherein at least one part of at least one electrode and parts electrically connected to an electrode or to the anode of the intensifier, bears a layer of organic polymer which is an electronic conductor of electricity having the property of reacting chemically with the alkaline metals that enter into the composition of the photocathode.

7. An improved tube according to claim 6, wherein this organic polymer is chosen from among the following polymers: polypyrrole, polythiophene, polyaniline, polyvinylferrocene, polythiazil, polyparaphenylene.

* * * * *

UNITED STATES PATENT AND TRADEMARK OFFICE

CERTIFICATE OF CORRECTION

PATENT NO. : 4,943,254

DATED : JULY 24, 1990

INVENTOR(S) : GÉRARD VIEUX ET AL.

It is certified that error appears in the above-identified patent and that said Letters Patent is hereby corrected as shown below:

On the title page:

In the inventors, delete "Gárard" before Vieux, and insert --Gérard--.

Signed and Sealed this

Twenty-fourth Day of September, 1991

*Attest:*

HARRY F. MANBECK, JR.

*Attesting Officer*

*Commissioner of Patents and Trademarks*